US011251538B2

(12) United States Patent
Lee et al.

(10) Patent No.: US 11,251,538 B2
(45) Date of Patent: Feb. 15, 2022

(54) ANTENNA MODULE

(71) Applicant: AMOTECH CO., LTD., Incheon (KR)

(72) Inventors: Se Ho Lee, Suwon-si (KR); Hyung Il Baek, Yongin-si (KR); Hyun Joo Park, Seoul (KR)

(73) Assignee: AMOTECH CO., LTD., Incheon (KR)

( * ) Notice: Subject to any disclaimer, the term of this patent is extended or adjusted under 35 U.S.C. 154(b) by 206 days.

(21) Appl. No.: 16/610,048

(22) PCT Filed: Apr. 30, 2018

(86) PCT No.: PCT/KR2018/005014
§ 371 (c)(1),
(2) Date: Oct. 31, 2019

(87) PCT Pub. No.: WO2018/203640
PCT Pub. Date: Nov. 8, 2018

(65) Prior Publication Data

US 2021/0305719 A1 Sep. 30, 2021

(30) Foreign Application Priority Data

May 2, 2017 (KR) ..... 10-2017-0056429

(51) Int. Cl.
*H01Q 21/00* (2006.01)
*H01Q 21/06* (2006.01)
*H01Q 9/04* (2006.01)

(52) U.S. Cl.
CPC ..... *H01Q 21/065* (2013.01); *H01Q 9/0414* (2013.01); *H01Q 21/0025* (2013.01)

(58) Field of Classification Search
CPC .... H01Q 21/065; H01Q 9/0414; H01Q 13/10; H01Q 19/10; H01Q 1/22; H01Q 1/2291;
(Continued)

(56) References Cited

U.S. PATENT DOCUMENTS 8,525,729 B1 * 9/2013 Martin ..... H01Q 21/061 343/700 MS
9,337,526 B2 5/2016 Hong et al.
(Continued)

FOREIGN PATENT DOCUMENTS

EP 3 561 953 A1 10/2019
JP 2000-138525 A 6/2000
(Continued)

OTHER PUBLICATIONS

EP Search Report in Application No. 18794886.4 dated Dec. 17, 2020.
(Continued)

*Primary Examiner* — Linh V Nguyen
(74) *Attorney, Agent, or Firm* — Maschoff Brennan

(57) ABSTRACT

Disclosed is an antenna module for minimizing the occurrence of breakdowns during the manufacturing thereof by adhering heterogeneous material, which adheres heterogeneous material base substrates with adhesive substrates. The disclosed antenna module has a plurality of first radiation patterns formed on the upper surface of a first base substrate, has a plurality of second radiation patterns and a plurality of chipsets formed on the upper surface and the lower surface of a second base substrate disposed below the first base substrate, has a first adhesive substrate interposed between the first base substrate and the second base substrate, wherein the first adhesive substrate has air gap holes formed therein so as to form air gaps between the plurality of first radiation patterns and the plurality of second radiation patterns.

13 Claims, 9 Drawing Sheets

(58) Field of Classification Search
CPC ..... H01Q 1/42; H01Q 1/48; H01Q 23/00; H01Q 9/0457; H01Q 21/0025
USPC ..... 343/893, 774, 700 MS, 822, 824
See application file for complete search history.

(56) References Cited

U.S. PATENT DOCUMENTS

| | | | | |
|---|---|---|---|---|
| 9,634,641 | B2 | 4/2017 | Nishimura et al. | |
| 10,892,547 | B2 * | 1/2021 | Rakib | H01Q 25/002 |
| 2003/0067410 | A1 * | 4/2003 | Puzella | H01Q 9/0407 343/700 MS |
| 2004/0264156 | A1 * | 12/2004 | Ajioka | H05K 1/144 361/818 |
| 2009/0015509 | A1 * | 1/2009 | Gottwald | H01Q 21/065 343/878 |
| 2010/0066631 | A1 * | 3/2010 | Puzella | H01Q 21/0087 343/853 |
| 2010/0177012 | A1 * | 7/2010 | Morrow | H01Q 21/0025 343/893 |
| 2014/0145883 | A1 | 5/2014 | Baks et al. | |
| 2015/0181739 | A1 | 6/2015 | Fukuda et al. | |
| 2015/0303586 | A1 * | 10/2015 | Hafenrichter | H01Q 21/0025 343/873 |
| 2016/0049723 | A1 * | 2/2016 | Baks | H01Q 1/2291 343/848 |
| 2017/0229784 | A1 * | 8/2017 | Kitamura | H01Q 21/065 |
| 2019/0326672 | A1 * | 10/2019 | Lim | H01Q 21/28 |

FOREIGN PATENT DOCUMENTS

| | | | |
|---|---|---|---|
| JP | 2004-327641 | A | 11/2004 |
| JP | 2015-091065 | A | 5/2015 |
| JP | 2017-028245 | A | 2/2017 |
| KR | 10-0877113 | B1 | 1/2009 |
| KR | 10-2013-0042909 | A | 4/2013 |
| KR | 10-2015-0012815 | A | 2/2015 |
| WO | 2006/012255 | A1 | 2/2006 |
| WO | 2014/020787 | A1 | 2/2014 |
| WO | 2016/056387 | A1 | 4/2016 |
| WO | 2016/131570 | A1 | 8/2016 |

OTHER PUBLICATIONS

JP Office Action in Application No. 2019-559764 dated Dec. 1, 2020.
CN Office Action in Application No. 201880036825.5 dated Mar. 5, 2021.

* cited by examiner

ANTENNA MODULE

TECHNICAL FIELD

The present disclosure relates to an antenna module, and more particularly, to an antenna module that operates as an antenna by resonating in a few tens of GHz bands.

BACKGROUND ART

As the demand for wireless data traffic increases after the commercialization of a 4G communication system, a 5G communication system for meeting the increasing traffic demand is below development.

Since a high data transfer rate is required to meet the increasing traffic demand, the 5G communication system is being studied to implement a communication system using an ultra-high frequency (mm-Wave) band of about 28 GHz or more.

Since the 5G communication system should increase the propagation distance of the radio wave while minimizing the path loss of the radio wave in the ultra-high frequency band, beamforming, massive MIMO, Full Dimensional MIMO (FD-MIMO), array antenna, analog beamforming, and large scale antenna technologies are being studied.

In general, in the conventional antenna module applied to the communication system, an antenna and a chipset are separated and installed, respectively. The antenna and the chipset are connected via a cable.

However, there is a problem in that the 5G communication system uses the ultra-high frequency band, thereby increasing the loss and degrading antenna performance if the conventional antenna module is applied as it is.

DISCLOSURE

Technical Problem

The present disclosure is intended to solve the above problem, and an object of the present disclosure is to provide an antenna module, which adheres base substrates of a heterogeneous material by using an adhesive substrate, thereby minimizing the occurrence of breakdown during the manufacturing thereof.

Further, another object of the present disclosure is to provide an antenna module having a high data transfer rate while minimizing the loss by forming an air gap between the radiation patterns formed on the base substrates through an air gap hole of the adhesive substrate.

Technical Solution

For achieving the objects, an antenna module according to an embodiment of the present disclosure includes a first base substrate, a plurality of first radiation patterns formed on the upper surface of the first base substrate, a second base substrate disposed below the first base substrate, a plurality of second radiation patterns formed on the upper surface of the second base substrate, a plurality of chipsets disposed on the lower surface of the second base substrate, and a first adhesive substrate interposed between the first base substrate and the second base substrate, and the first adhesive substrate has an air gap hole formed therein, and the air gap hole forms an air gap between the plurality of first radiation patterns and the plurality of second radiation patterns.

Advantageous Effects

According to the present disclosure, it is possible for the antenna module to stack the first antenna part and the second antenna part made of a heterogeneous material, thereby preventing breakdown of the first antenna part and the second antenna part during the manufacturing of the antenna module.

Further, it is possible for the antenna module to adhere the first antenna part and the second antenna part by using the first adhesive part having the air gap hole formed therein, thereby forming the air gap between the plurality of first radiation patterns formed on the first antenna part and the plurality of second radiation patterns formed on the second antenna part while preventing breakdown of the first antenna part and the second antenna part during the manufacturing of the antenna module.

Further, it is possible for the antenna module to form the air gap between the first radiation pattern and the second radiation pattern, thereby operating as the antenna that receives the frequency band signal such as 5th generation mobile communications (5G) and Wireless Gigabit Alliance (WiGig), which are high frequency bands.

Further, it is possible for the antenna module to form the air gap between the first antenna part and the second antenna part made of a heterogeneous material, thereby implementing the high data transfer rate by increasing the propagation distance of the radio wave while minimizing the occurrence of breakdown during the manufacturing thereof and minimizing the path loss of the radio wave.

BEST MODE

Figure 1:
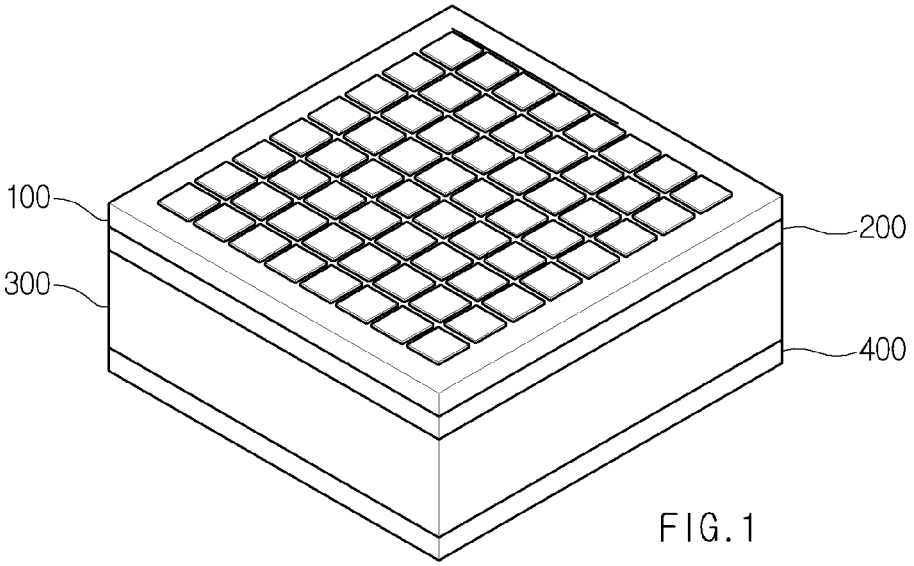
FIGS. 1 and 2 are perspective diagrams of an antenna module according to an embodiment of the present disclosure.
Figure 2:
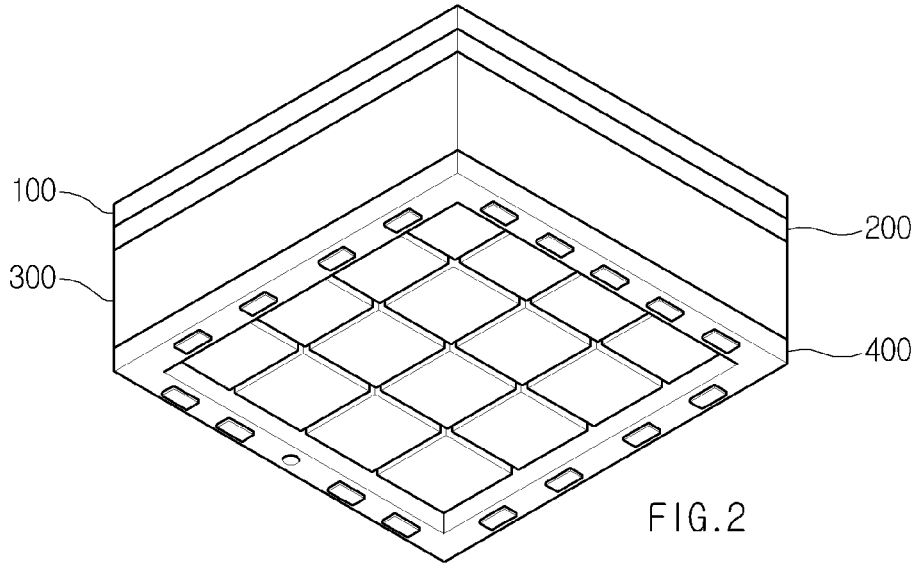

Hereinafter, the most preferred embodiments of the present disclosure will be described in detail with reference to the accompanying drawings so that those skilled in the art to which the present disclosure pertains may easily carry out the technical spirit of the present disclosure. First, in adding reference numerals to the components of each drawing, it should be noted that the same components have the same reference numerals as much as possible even if they are displayed on different drawings. Further, in describing the present disclosure, when it is determined that the detailed description of the related well-known configuration or function may obscure the gist of the present disclosure, the detailed description thereof will be omitted.

Referring to FIGS. 1 to 5, an antenna module according to an embodiment of the present disclosure is an antenna mounted in a base station or a portable terminal of a 5G communication system.

The antenna module is configured to include a first antenna part 100, a first adhesive part 200, a second antenna part 300, and a second adhesive part 400. The first antenna part 100 is disposed on the uppermost portion of the antenna module. The first adhesive part 200, the second antenna part 300, and the second adhesive part 400 are sequentially stacked below the first antenna part 100. Accordingly, the antenna module is formed of an Antenna in Package (AiP) in which a plurality of radiation patterns are disposed on the uppermost portion thereof and a plurality of chipsets 360 are disposed on the lowermost portion thereof.

The first antenna part 100 and the second antenna part 300 are composed of a base substrate of a heterogeneous material. The radiation pattern is formed on the upper surface of the first antenna part 100 and the upper surface of the second antenna part 300, respectively. The plurality of chipsets 360 are formed on the lower surface of the second antenna part 300.

The first adhesive part 200 is interposed between the first antenna part 100 and the second antenna part 300. The first adhesive part 200 adheres the first antenna part 100 and the second antenna part 300. The first adhesive part 200 has is formed with a hole configured to accommodate the radiation pattern of the second antenna part 300. At this time, the hole formed in the first adhesive part 200 forms an air gap between the first antenna part 100 and the second antenna part 300. The hole formed in the first adhesive part 200 forms the air gap between the radiation pattern of the first antenna part 100 and the radiation pattern of the second antenna part 300.

The second adhesive part 400 is adhered to the lower surface of the second antenna part 300. The second adhesive part 400 is formed with a hole configured to accommodate the plurality of chipsets 360 formed on the lower surface of the second antenna part 300. A plurality of external terminal patterns 480 and input terminals 460 are formed on the lower surface of the second adhesive part 400. The external terminal pattern 480 is a terminal configured to connect the antenna module with an external circuit. The input terminal 460 is a terminal configured to receive a signal from an external circuit.

The first antenna part 100 includes a first base substrate 120. The first base substrate 120 is composed of a plate-shaped substrate. The first base substrate 120 may be composed of a substrate such as a Rogers substrate, Flame Retardant Type 4 (FR-4), Teflon, Polyimide, or polyethylene, which is generally used for a circuit substrate.

The first antenna part 100 further includes a plurality of first radiation patterns 140. At this time, the plurality of first radiation patterns 140 correspond to the radiation patterns disposed on the uppermost portion of the antenna module.

The plurality of first radiation patterns 140 may be made of a metal material such as copper (Cu) or silver (Ag). The plurality of first radiation patterns 140 are formed on the upper surface of the first base substrate 120 through a printing process. The plurality of first radiation patterns 140 may be disposed in a matrix on the upper surface of the first base substrate 120.

Figure 6:
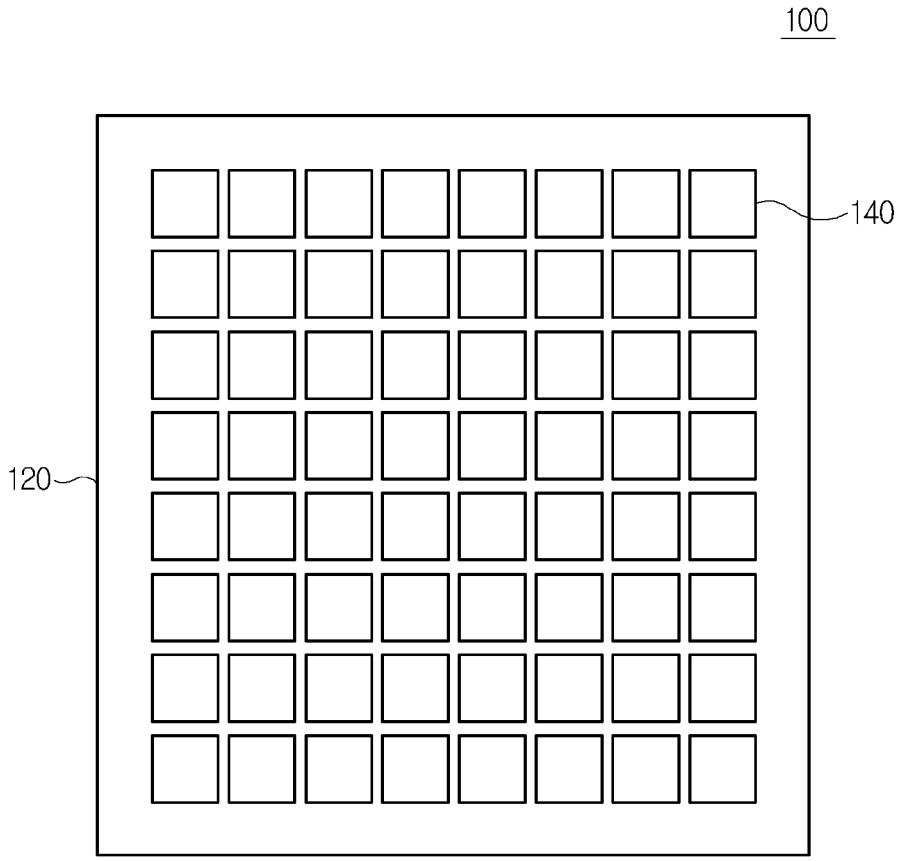
FIG. 6 is a top diagram of a first base substrate illustrated in FIG. 1.

Referring to FIG. 6, the plurality of first radiation patterns 140 may be, for example, composed of 64 pieces and disposed in eight rows and eight columns on the upper surface of the first base substrate 120. Here, the number and matrix structure of the first radiation pattern 140 may be formed variously according to the characteristics and size of the antenna.

The first adhesive part 200 is interposed between the first antenna part 100 and the second antenna part 300 to adhere the first antenna part 100 and the second antenna part 300. The upper surface of the first adhesive part 200 is adhered to the lower surface of the first base substrate 120. The lower surface of the first adhesive part 200 is adhered to the upper surface of the second base substrate 320.

To this end, the first adhesive part 200 includes a first adhesive substrate 220. The first adhesive substrate 220 is composed of a plate-like dielectric. For example, the first adhesive substrate 220 is a plate-shaped FR-4 substrate.

The first adhesive part 200 forms an air gap between the first antenna part 100 and the second antenna part 300.

To this end, the first adhesive part 200 further includes an air gap hole 240 formed by penetrating the first adhesive substrate 220. The air gap hole 240 forms an air gap between the first antenna part 100 and the second antenna part 300 as the first adhesive part 200 is interposed between the first antenna part 100 and the second antenna part 300.

The air gap hole 240 is disposed between the lower surface of the first base substrate 120 and the upper surface of the second base substrate 320. The air gap hole 240 forms an air gap between the plurality of first radiation patterns 140 and the plurality of second radiation patterns 340. At this time, the air gap hole 240 accommodates the plurality of second radiation patterns 340 formed on the upper surface of the second base substrate 320.

Figure 7:
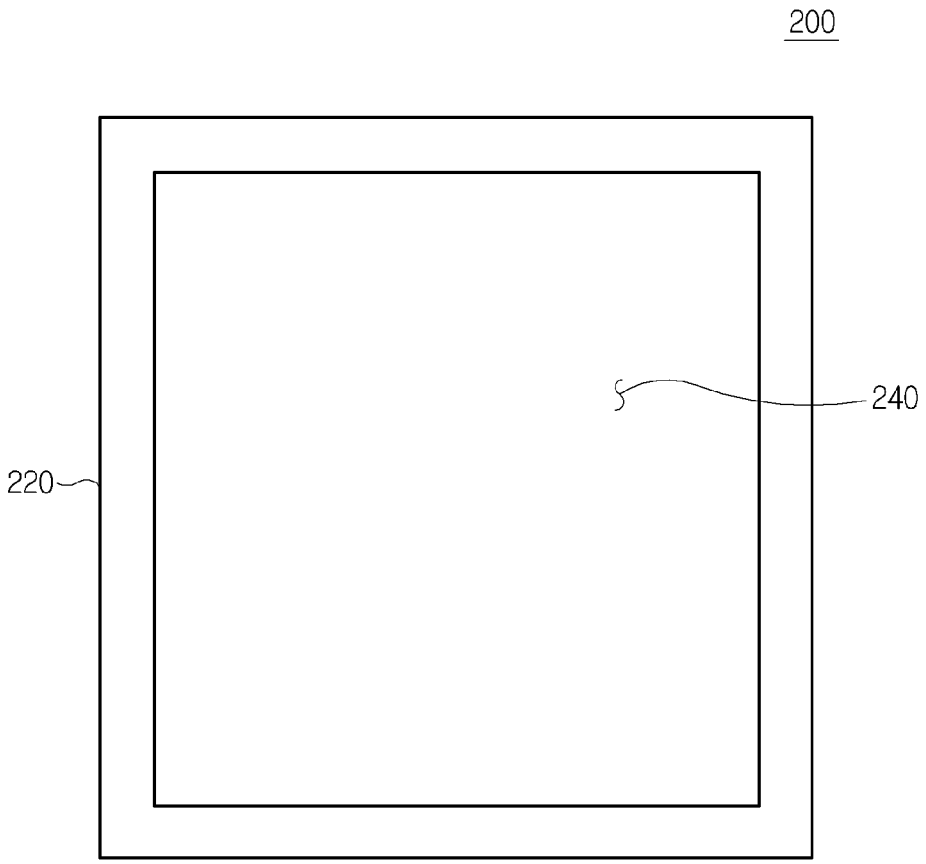
FIG. 7 is a top diagram of a first adhesive part illustrated in FIG. 1.

Referring to FIG. 7, the first adhesive part 200 is formed in a frame (or donut) shape as the air gap hole 240 is formed in the first adhesive substrate 220. The upper surface of the first adhesive part 200 is adhered to the lower surface of the first base substrate 120. The upper surface of the first adhesive part 200 is adhered along the outer circumference of the lower surface of the first base substrate 120. The lower surface of the first adhesive part 200 is adhered to the upper surface of the second base substrate 320. The lower surface of the first adhesive part 200 is adhered along the outer circumference of the upper surface of the second base substrate 320.

Meanwhile, the first adhesive part 200 may include a plurality of air gap holes 240. The first adhesive part 200 may be formed in a lattice structure in which the plurality of air gap holes 240 are formed in a multi-row and a multi-column. At this time, one or more second radiation patterns 340 may be accommodated in one air gap hole 240.

As described above, it is possible for the antenna module to stack the first antenna part 100 and the second antenna part 300 made of a heterogeneous material, thereby preventing breakdown of the first antenna part 100 and the second antenna part 300 during the manufacturing of the antenna module.

Further, it is possible for the antenna module to adhere the first antenna part 100 and the second antenna part 300 by using the first adhesive part 200 having the air gap hole 240 formed therein, thereby forming the air gap between the plurality of first radiation patterns 140 formed on the first antenna part 100 and the plurality of second radiation patterns 340 formed on the second antenna part 300 while preventing breakdown of the first antenna part 100 and the second antenna part 300 during the manufacturing of the antenna module.

Further, it is possible for the antenna module to form the air gap between the first radiation pattern 140 and the second radiation pattern 340, thereby operating as an antenna that receives a frequency band signal such as 5th generation mobile communications (5G) or Wireless Gigabit Alliance (WiGig), which is a high frequency band.

Further, it is possible for the antenna module to form the air gap between the first antenna part 100 and the second antenna part 300 made of a heterogeneous material, thereby implementing a high data transfer rate by increasing the propagation distance of the radio wave while the occurrence of breakdown during the manufacturing thereof and minimizing the path loss of the radio wave.

The second antenna part 300 includes the second base substrate 320 adhered to the lower surface of the first adhesive part 200. The second base substrate 320 is made of a plate-shaped ceramic material. For example, the second base substrate 320 may be a Low Temperature Co-fired Ceramic (LTCC). The second base substrate 320 may also be made of a ceramic material containing at least one among alumina (Al2O3), zirconium oxide (ZrO2), aluminum nitride (AlN), and silicon nitride (Si3N4).

The second antenna part 300 further includes the plurality of second radiation patterns 340 formed on the upper surface of the second base substrate 320. The plurality of second radiation patterns 340 are made of a metal material such as copper (Cu) and silver (Ag). The plurality of second radiation patterns 340 are formed on the upper surface of the second base substrate 320 through a printing process. The plurality of second radiation patterns 340 may be disposed in a matrix on the upper surface of the second base substrate 320.

Figure 8:
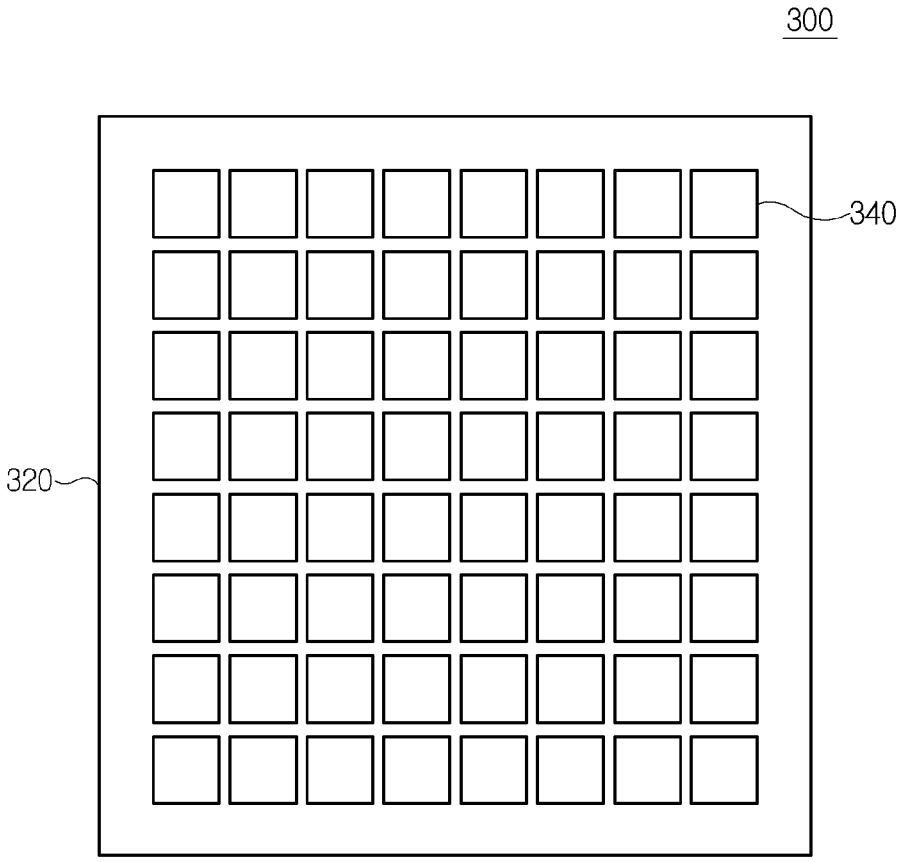
FIG. 8 is a top diagram of a second antenna part illustrated in FIG. 1.

Referring to FIG. 8, the plurality of second radiation patterns 340 may be, for example, composed of 64 pieces, and disposed in eight rows and eight columns on the upper surface of the second base substrate 320. Here, the number and matrix structure of the second radiation pattern 340 may be formed variously according to the characteristics and the size of the antenna.

The number and matrix structure of the second radiation pattern 340 is preferably formed to be the same as the first radiation pattern 140. Of course, the number and matrix structure of the first radiation pattern 140 and the second radiation pattern 340 may also be formed variously according to the antenna characteristics.

The second radiation pattern 340 is formed to overlap one of the plurality of first radiation patterns 140 with the air gap hole 240 interposed therebetween. Here, the overlapping may be understood as the second radiation pattern 340 overlapping the entire surface of one of the plurality of first radiation patterns 140. The overlapping may also be understood as the second radiation pattern 340 overlapping a portion of one of the plurality of first radiation patterns 140.

As the plurality of second radiation patterns 340 overlap the plurality of first radiation patterns 140 with the air gap hole 240 interposed therebetween, the second radiation pattern 340 and the first radiation pattern 140 become a coupling. Here, the coupling means a state where it is electromagnetically coupled to each other in a state spaced apart from each other, rather than a state electrically, directly connected to each other.

The second antenna part 300 further includes a plurality of connection patterns 380 formed in the second base substrate 320.

The plurality of connection patterns 380 are made of a metal material such as copper (Cu) and silver (Ag). The plurality of connection patterns 380 connect the second radiation pattern 340 and the chipset 360 formed on the upper surface and the lower surface of the second base substrate 320, respectively.

The plurality of connection patterns 380 processes signal transmission between the chipset 360 and the second radiation pattern 340. The plurality of connection patterns 380 transmit a signal received through the first radiation pattern 140 and the second radiation pattern 340 to the chipset 360. The plurality of connection patterns 380 may also transmit the signal input to the chipset 360 to the first radiation pattern 140 and the second radiation pattern 340.

The plurality of connection patterns 380 may be composed of a via hole penetrating the second base substrate 320. The plurality of connection patterns 380 may be formed by plating a metal material such as copper or silver on the inner wall surface of the via hole. The plurality of connection patterns 380 may be formed by filling a metal material in the via hole.

Figure 3:
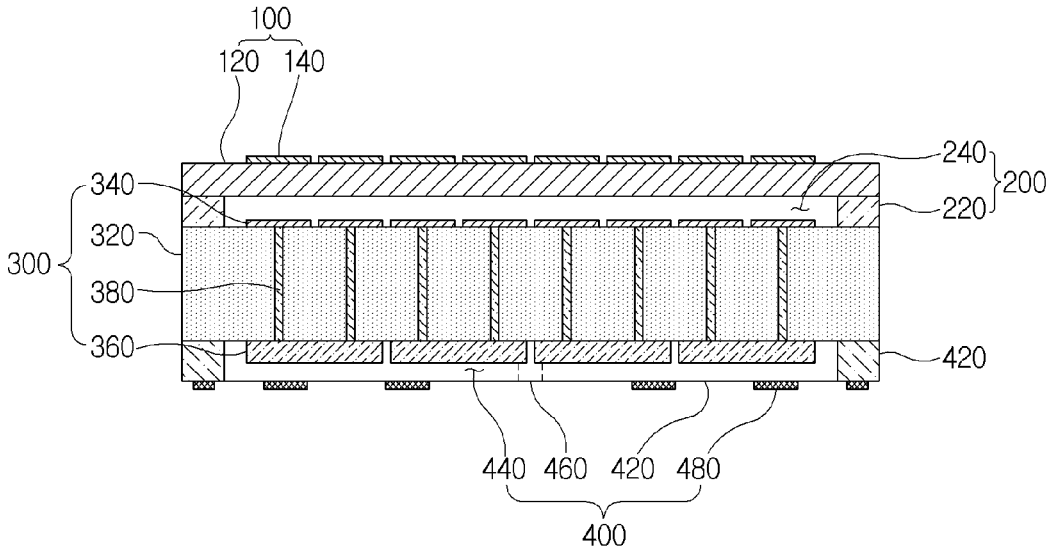
FIG. 3 is a cross-sectional diagram of an antenna module according to an embodiment of the present disclosure.
Figure 4:
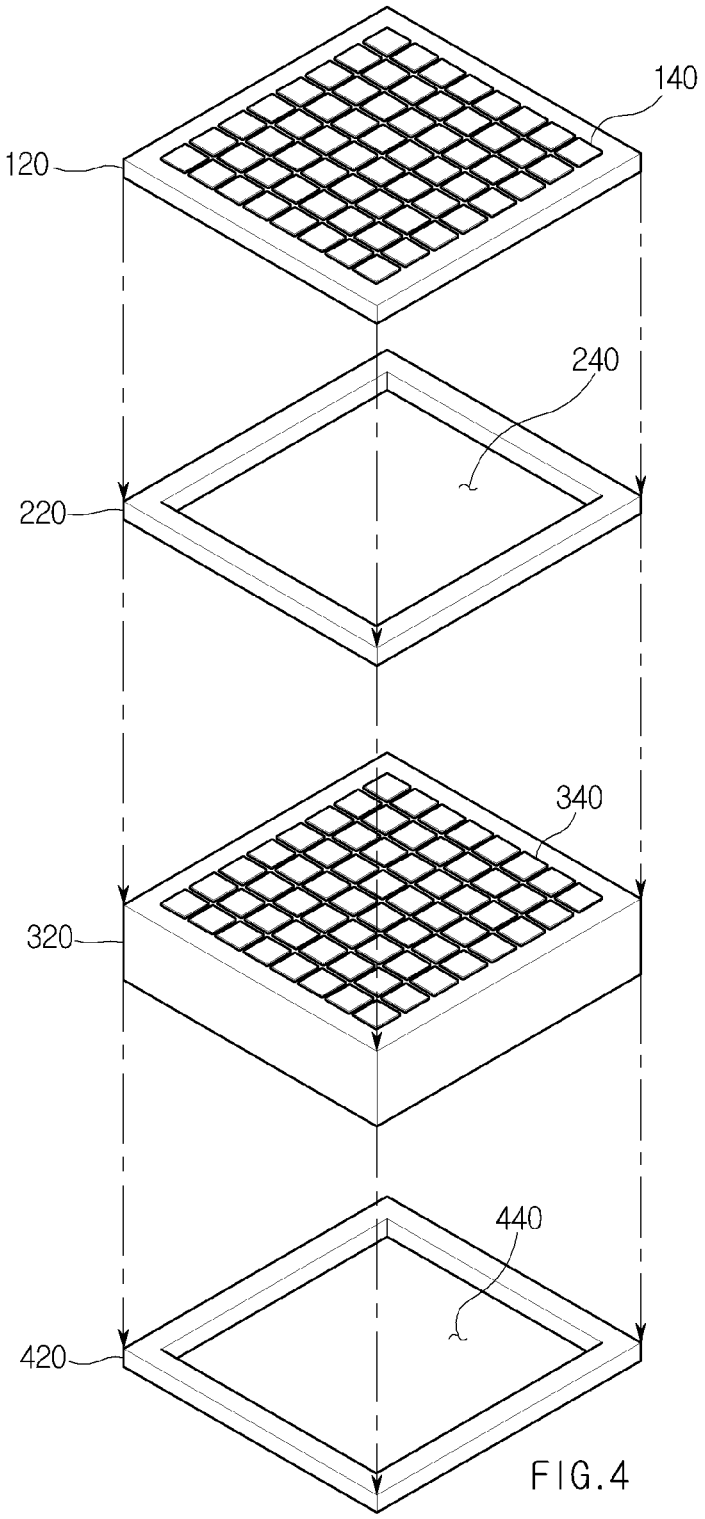
FIGS. 4 and 5 are exploded perspective diagrams of an antenna module according to an embodiment of the present disclosure.
Figure 5:
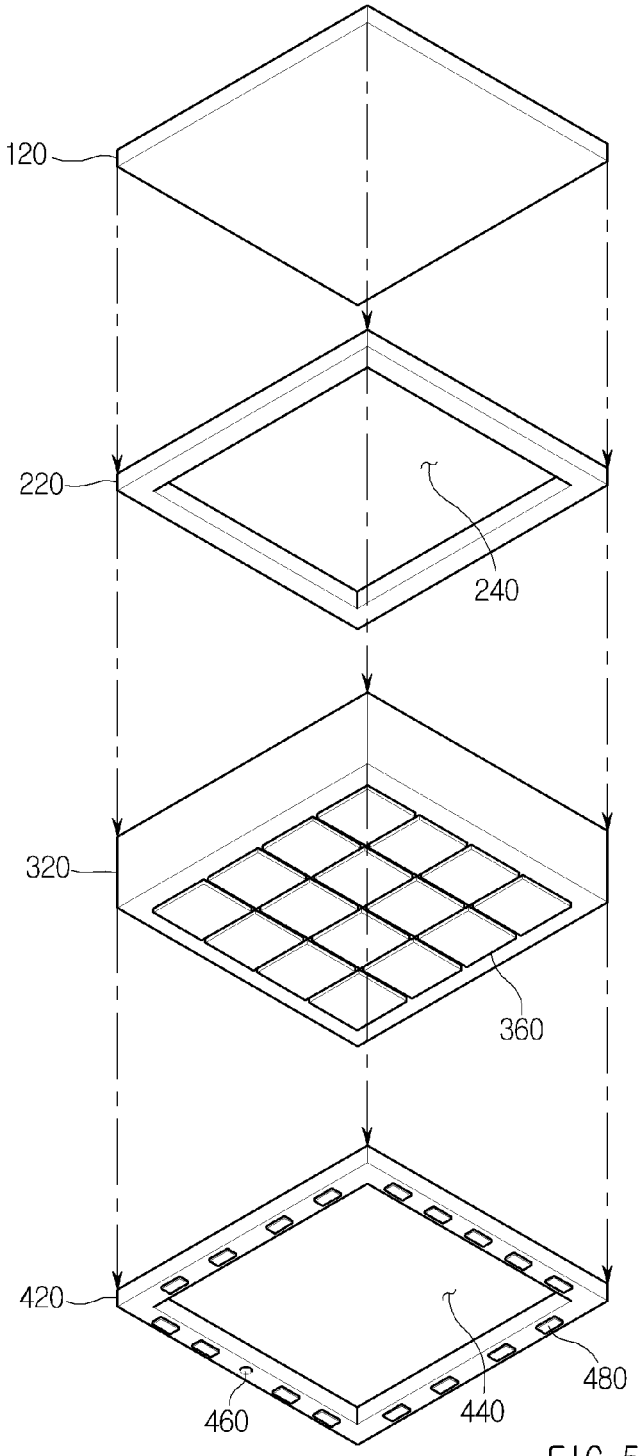

Here, although it has been illustrated in FIG. 3 that the plurality of connection patterns 380 vertically penetrate the second base substrate 320 to connect the second radiation pattern 340 and the chipset 360 in order to easily explain the antenna module according to an embodiment of the present disclosure, it is not limited thereto and may be formed in various forms.

Further, the second base substrate 320 may be formed in a multi-layer structure in order to form the plurality of connection patterns 380. At this time, the second base substrate 320 may form a metal pattern on at least one surface of each layer, and form the plurality of connection patterns 380 by connecting metal patterns through the via hole formed in each layer.

The second antenna part 300 further includes a plurality of chipsets 360 formed on the lower surface of the second base substrate 320. The plurality of chipsets 360 may be disposed in a matrix on the lower surface of the second base substrate 320. The plurality of second radiation patterns 340 are connected to one chipset 360 through the connection pattern 380.

Figure 9:
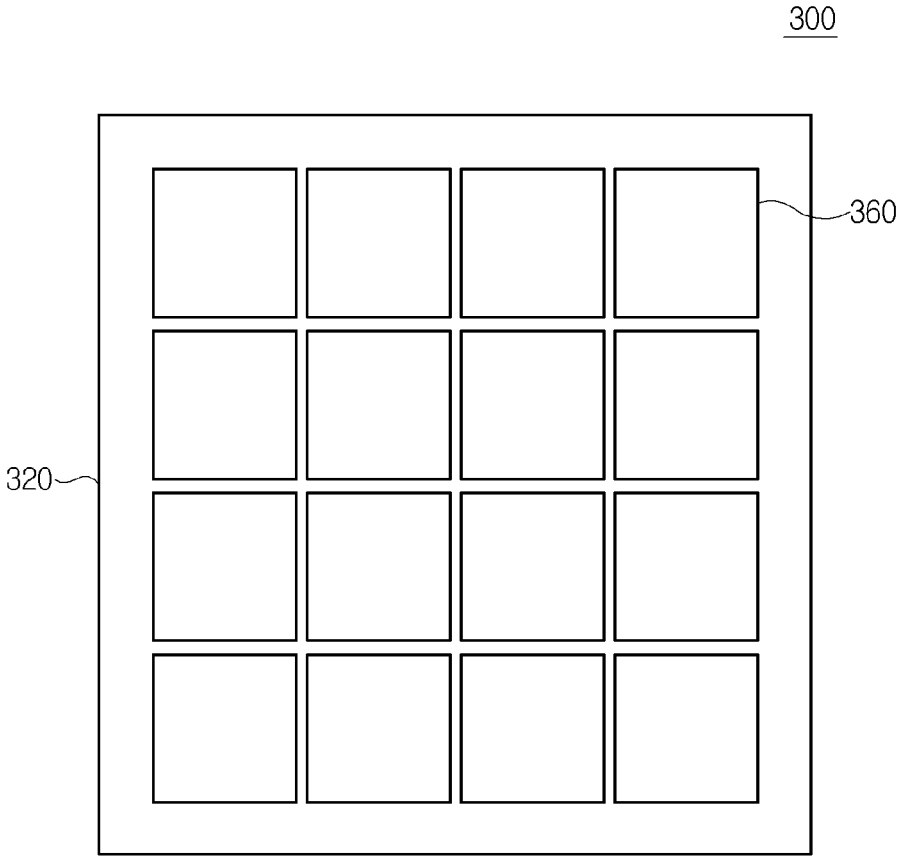
FIG. 9 is a bottom diagram of the second antenna part illustrated in FIG. 1.

Referring to FIG. 9, if there are 64 second radiation patterns 340 and four second radiation patterns 340 are connected to one chipset 360, the plurality of chipsets 360 may be composed of 16 pieces and disposed in four rows and four columns on the lower surface of the second base substrate 320. Here, the number and matrix structure of the chipset 360 may be formed variously according to the number and processing capacity of the second radiation pattern 340 to be connected.

The second adhesive part 400 is disposed at the lowermost portion of the antenna module. The second adhesive part 400 accommodates the chipset 360 formed below the second antenna part 300. The external terminal pattern 480 for connecting with an external circuit substrate is formed below the second adhesive part 400. The input terminal 460 configured to receive a signal from the external circuit substrate may be formed below the second adhesive part 400.

The second adhesive part 400 is adhered to the lower surface of the second antenna part 300. The upper surface of the second adhesive part 400 is adhered to the lower surface of the second antenna part 300. To this end, the second adhesive part 400 includes a second adhesive substrate 420. The second adhesive substrate 420 is composed of a plate-shaped dielectric. For example, the second adhesive substrate 420 is a plate-shaped FR-4 substrate.

The second adhesive part 400 further includes an accommodation hole 440 formed by penetrating the second adhesive substrate 420. The accommodation hole 440 accommodates the plurality of chipsets 360 formed on the lower surface of the second antenna part 300 as the second adhesive part 400 is adhered to the lower surface of the second antenna part 300. At this time, the thickness of the accommodation hole 440 may be formed thicker than the thickness of the chipset 360.

Figure 10:
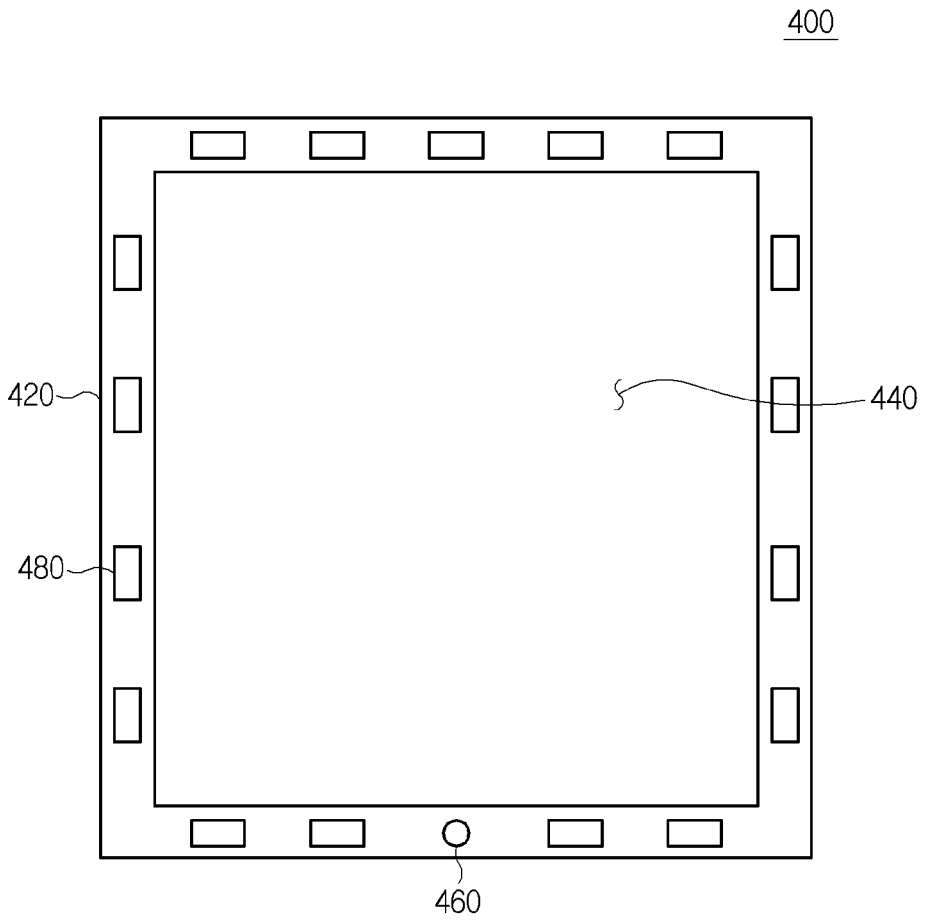
FIG. 10 is a top diagram of a second adhesive part illustrated in FIG. 1.

Referring to FIG. 10, the second adhesive part 400 is formed in a frame (or donut) shape as the accommodation hole 440 is formed in the second adhesive substrate 420. The upper surface of the second adhesive part 400 is adhered to the lower surface of the second base substrate 320. The upper surface of the second adhesive part 400 is adhered along the outer circumference of the lower surface of the second base substrate 320. The lower surface of the second adhesive part 400 is adhered to the upper surface of the circuit substrate on which the antenna module is mounted.

At this time, the second adhesive part 400 further includes a plurality of external terminal patterns 480 configured to connect the antenna module with the circuit substrate.

The plurality of external terminal patterns 480 may be made of a metal material such as copper or silver. The plurality of external terminal patterns 480 are formed on the lower surface of the second adhesive substrate 420 through a printing process. The plurality of external terminal patterns 480 may be disposed to be spaced apart from each other on the lower surface of the second adhesive substrate 420. The plurality of external terminal patterns 480 may be connected with the chipset 360 through the patterns formed on the second adhesive substrate 420 and the second base substrate 320.

The plurality of external terminal patterns 480 are electrically connected directly to the terminal of the circuit substrate as the antenna module is mounted on the circuit substrate. The plurality of external terminal patterns 480 may also be connected to the circuit substrate through a cable or a connection circuit substrate.

The second adhesive part 400 may further include the input terminal 460 configured to receive an external signal. The input terminal 460 receives the external signal to transmit it to the chipset 360. To this end, the input terminal 460 may be connected with the chipset 360 through the patterns formed on the second adhesive substrate 420 and the second base substrate 320.

As described above, although preferred embodiments according to the present disclosure has been described, it may be modified in various forms, and it is understood by those skilled in the art that various modified examples and changed examples may be practiced without departing from the claims of the present disclosure.

The invention claimed is:

1. An antenna module, comprising:

a first base substrate;

a plurality of first radiation patterns formed on an upper surface of the first base substrate;

a second base substrate disposed below the first base substrate;

a plurality of second radiation patterns formed on an upper surface of the second base substrate;

a plurality of chipsets disposed on a lower surface of the second base substrate;

a first adhesive substrate interposed between the first base substrate and the second base substate;

a second adhesive substrate formed with an accommodation hole that accommodates the plurality of chipsets, and disposed on the lower surface of the second base substrate; and an input terminal formed on the lower surface of the second adhesive substrate, wherein the first adhesive substrate is formed with an air gap hole having the plurality of second radiation patterns accommodated therein, wherein the air gap hole forms an air gap between the plurality of first radiation patterns and the plurality of second radiation patterns, wherein the plurality of first radiation patterns are disposed in a matrix on the upper surface of the first base substrate, and the plurality of second radiation patterns are disposed in a matrix on the upper surface of the second base substrate, and wherein the plurality of chipsets are disposed in a matrix on the lower surface of the second base substrate, and each of the plurality of chipsets is connected with two or more second radiation patterns.

2. The antenna module of claim 1, wherein the first adhesive substrate is formed in a frame, and wherein the upper surface of the first adhesive substrate is disposed along the outer circumference of the lower surface of the first base substrate, and the lower surface of the first adhesive substrate is disposed along the outer circumference of the upper surface of the second base substrate.

3. The antenna module of claim 1, wherein the plurality of second radiation patterns overlap one first radiation pattern with the air gap hole interposed therebetween, respectively.

4. The antenna module of claim 1, wherein the air gap hole accommodates the plurality of second radiation patterns.

5. The antenna module of claim 1, wherein the first adhesive substrate is formed in a lattice structure in which a plurality of air gap holes are disposed in a matrix.

6. The antenna module of claim 5, wherein the plurality of air gap holes accommodate one or more second radiation patterns, respectively.

7. The antenna module of claim 1, wherein the air gap hole forms an air gap between the lower surface of the first base substrate and the upper surface of the second base substrate.

8. The antenna module of claim 1, further comprising a plurality of connection patterns formed on the second base substrate, wherein the plurality of connection patterns connect the plurality of second radiation patterns with the plurality of chipsets.

9. The antenna module of claim 1, wherein the second adhesive substrate is formed with a plurality of accommodation holes, and wherein the plurality of accommodation holes accommodate one or more chipsets, respectively.

10. The antenna module of claim 1, wherein the thickness of the second adhesive substrate is formed thicker than the thickness of the plurality of chipsets.

11. The antenna module of claim 1, wherein the second adhesive substrate is formed in a frame shape and disposed on the lower surface of the second base substrate, and disposed along the outer circumference of the lower surface of the second base substrate.

12. The antenna module of claim 1, wherein the second base substrate is a plated-shaped Low Temperature Co-fired Ceramic material.

13. The antenna module of claim 12,
wherein the first base substrate is made of a different material from that of the second base substrate.

* * * * *